US007165821B2

(12) United States Patent
Chuan

(10) Patent No.: US 7,165,821 B2
(45) Date of Patent: Jan. 23, 2007

(54) DRAWER ASSEMBLY

(76) Inventor: Lin Ming Chuan, 11F-2, No. 43, Chai -I Street, Taichung City (TW)

( * ) Notice: Subject to any disclaimer, the term of this patent is extended or adjusted under 35 U.S.C. 154(b) by 0 days.

(21) Appl. No.: 10/813,511

(22) Filed: Mar. 29, 2004

(65) Prior Publication Data

US 2005/0212391 A1 Sep. 29, 2005

(51) Int. Cl.
*A47B 88/00* (2006.01)
*A47B 47/00* (2006.01)

(52) U.S. Cl. ..... 312/348.2; 312/348.4; 220/4.34

(58) Field of Classification Search ..... 312/348.1, 312/348.2, 348.4, 348.6, 257.1, 330.1, 263, 312/265.5, 265.6; 220/4.31, 4.33, 4.34
See application file for complete search history.

(56) References Cited

U.S. PATENT DOCUMENTS 343,588 A * 6/1886 Lewis ..... 217/15
733,552 A * 7/1903 MacDonald ..... 220/4.34
1,822,448 A * 9/1931 Morin ..... 312/258
2,919,045 A * 12/1959 Waugh et al. ..... 220/4.34
3,024,075 A * 3/1962 Howe ..... 312/348.4
3,246,828 A * 4/1966 Branscum et al. ..... 220/4.34
3,819,079 A * 6/1974 Levens ..... 220/4.13
4,098,199 A * 7/1978 Haje ..... 109/52
4,300,695 A * 11/1981 Hsu ..... 220/6
4,789,075 A * 12/1988 Sun ..... 220/4.34
5,161,870 A * 11/1992 Mason et al. ..... 312/348.4
6,631,821 B2 * 10/2003 Vourganas ..... 220/1.5

* cited by examiner

*Primary Examiner*—Janet M. Wilkens
(74) *Attorney, Agent, or Firm*—Charles E. Baxley

(57) ABSTRACT

A drawer assembly includes four side boards and each of the side boards has at lease one lug on two ends and one of two sides thereof, and a bottom board which has lugs one four sides thereof. The four side boards are connected to be a four-side frame by connecting the at least one lugs by four pins. The four-side frame is connected to the bottom board by connecting the at least one lugs of the four-side frame to the lugs on the four sides of the bottom board. The drawer assembly requires no tools or welding machine to assemble a drawer within a short period of time.

1 Claim, 3 Drawing Sheets

DRAWER ASSEMBLY

FIELD OF THE INVENTION

The present invention relates to a drawer assembly that is composed of four side boards which are connected to fours sides of a bottom board by extending pins through lugs on respective sides of the side boards and the bottom board.

BACKGROUND OF THE INVENTION

A conventional drawer and box generally includes four side boards and a bottom board is connected to the four side boards. The connection can be made by using nails for wood material, or by welding if the material of the side boards and the bottom board is metal. Some manufacturers use clamp member to connect the adjacent side boards and the bottom boards by rivets or nails. Nevertheless, a common problem of these connections is that the final products occupy too much space which is not convenient for transportation or storage. Besides, a lot of labors are required to nail or weld the individual boards and this also spends a lot of time.

The present invention intends to provide a drawer assembly which can be easily and quickly assembled without using expensive machine or tools.

SUMMARY OF THE INVENTION

The present invention relates to a drawer assembly which comprises four side boards and a bottom board. Each of the four side boards has at least one first lug on each of two ends thereof, and at least one second lug on one of two opposite sides of each of the four side boards. The four side boards are connected to form a four-side frame by connecting the respective at least one first lugs on the adjacent ends of adjacent side boards by four pins. The bottom board has at least one third lug on each of four sides thereof, and four second pins extend through the respective at least one third lugs and the respective at least one second lugs.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
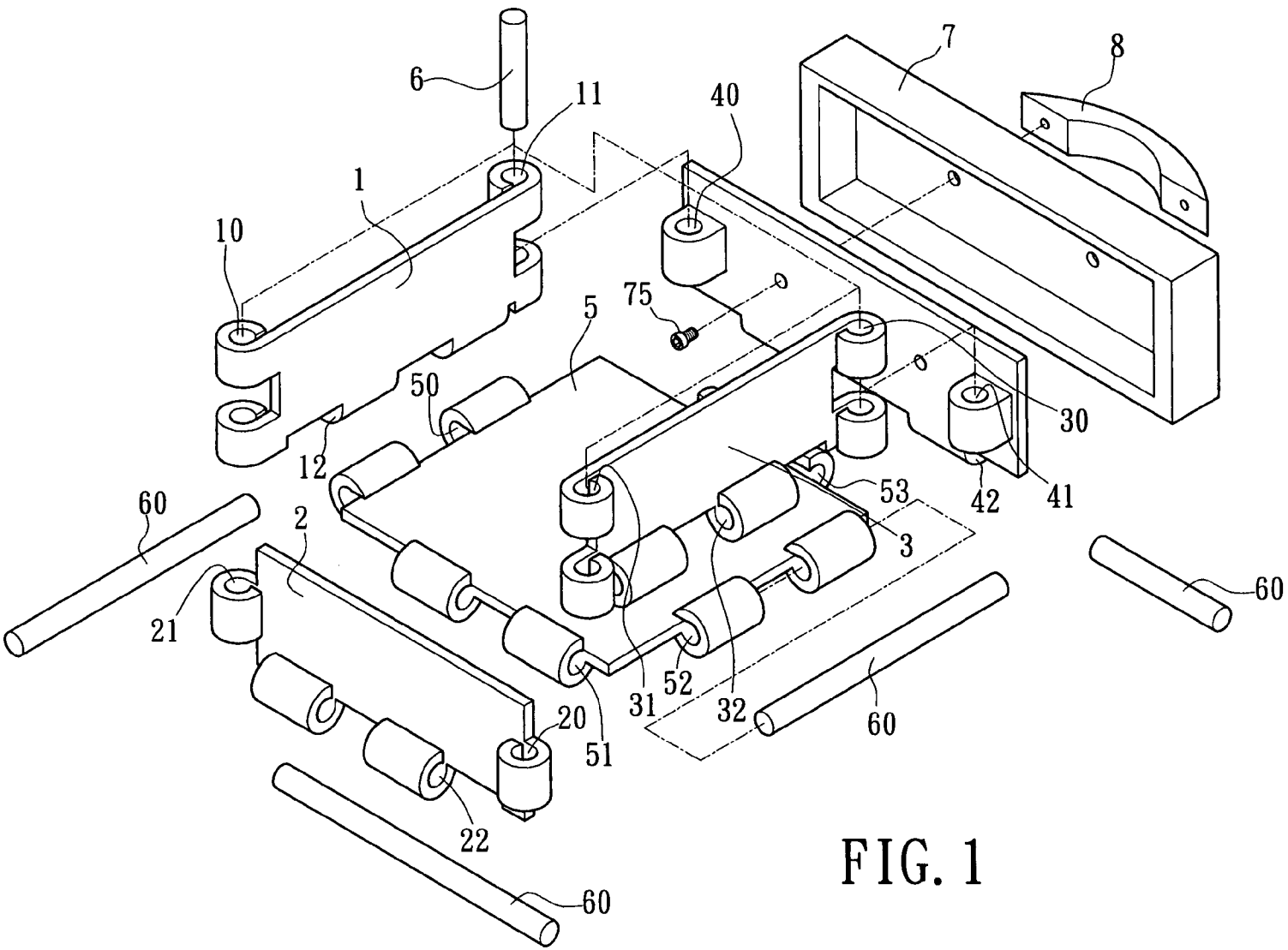
FIG. 1 is an exploded view to show the drawer assembly of the present invention.
Figure 3:
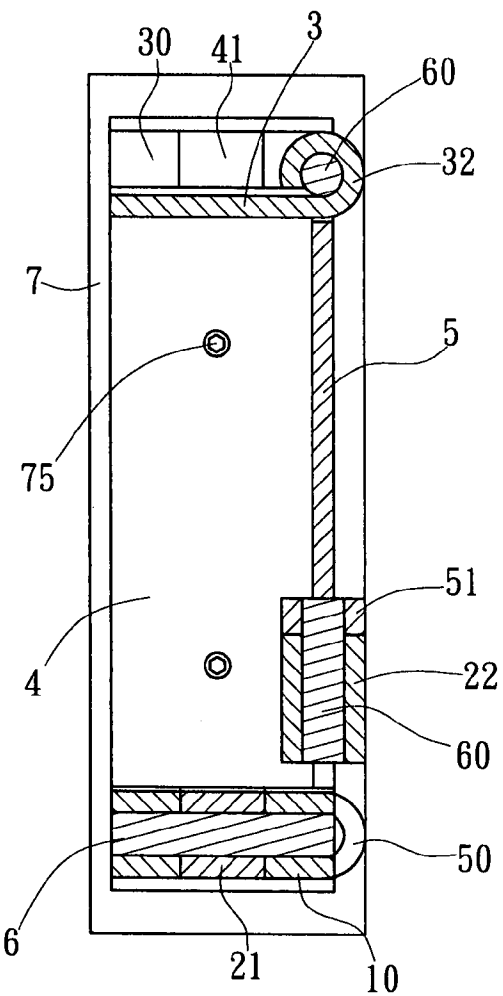
FIG. 3 shows a cross sectional view taken along the line in FIG. 2.
Figure 2:
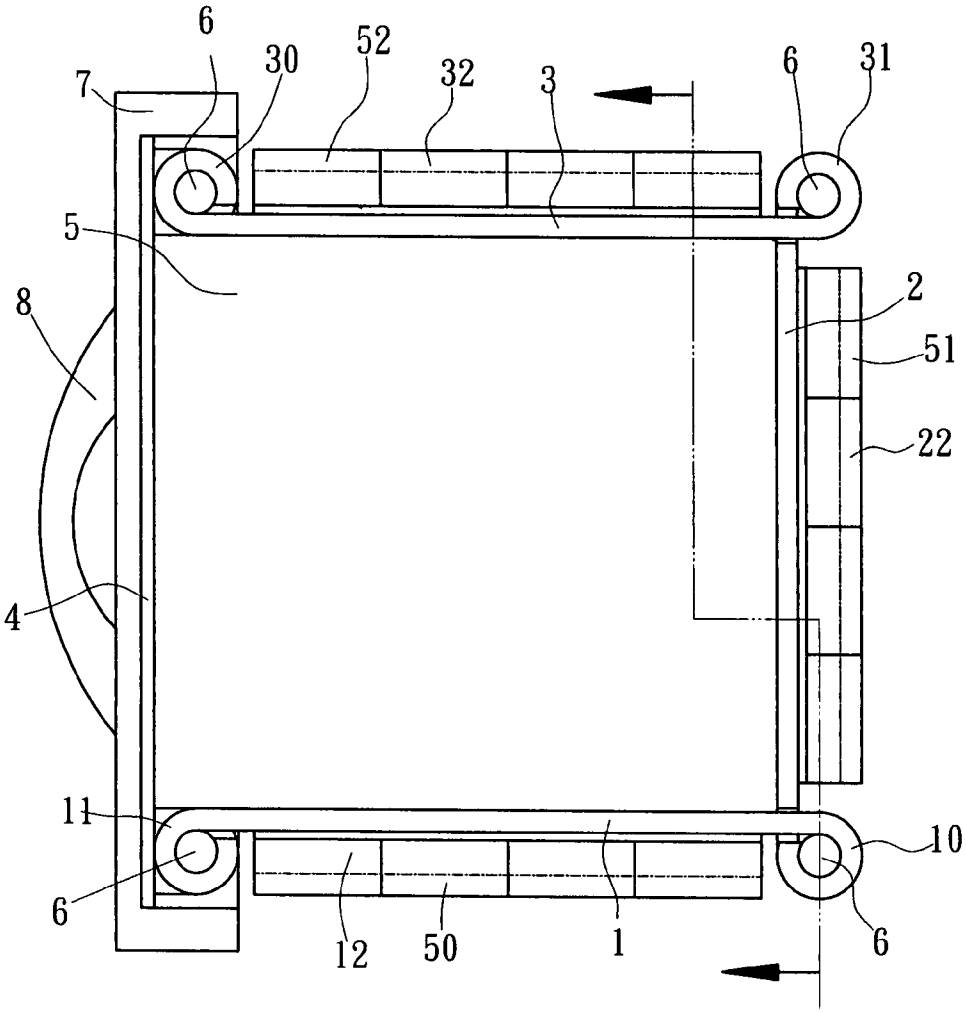
FIG. 2 is a top view to show the drawer assembly of the present invention.

Referring to FIGS. 1 to 3, the drawer assembly of the present invention comprises a four side boards and a bottom board 5. The four side boards are connected to form a four-side frame and composed of two side panels 1, 3, a front panel 4 and a rear panel 2. Each of the two side panels has two first lug 10 and 11/30 and 31 on each of two ends thereof. Two second lugs 12/32 are located on one of two opposite sides of each of the two side panels 1, 3. Each of the rear panel 2 and the front panel 4 has a third lug 20/21/40/41 connected to each one of two ends thereof. Two fourth lugs 22/42 are connected to one of two sides of each of the rear panel 2 and the front panel 4.

The two third lugs 40 and 41 of the front panel 4 are respectively located between the two sets of first lugs 11 and 30 of the two side panels 1, 3, and two first pins 6 extend through the aligned third lugs 40, 41 and the first lugs 11, 30. The two third lugs 20 and 21 of the rear panel 2 are respectively located between the two sets of first lugs 10 and 31 of the two side panels 1, 3, and another two first pins 6 extend through the aligned third lugs 20, 21 and the first lugs 10, 31.

The bottom board 5 has two fifth lugs 50/51/52/53 on each of four sides thereof. The four-side frame composed of the two side panels 1, 3, the front panel 4 and the rear panel 2 is connected to the four sides of the bottom board 5 by extending four second pins 60 through the second lugs 12, 32, the fourth lugs 22, 42 and the fifth lugs 50/51/52/53.

A front part 7 that includes four sides and a front board connected to the four sides. A handle 8 is fixed to an outside of the front board by two bolts 75 extending through the front panel 4, the front board of the front part 7 and connected to the handle 8.

Figure 4:
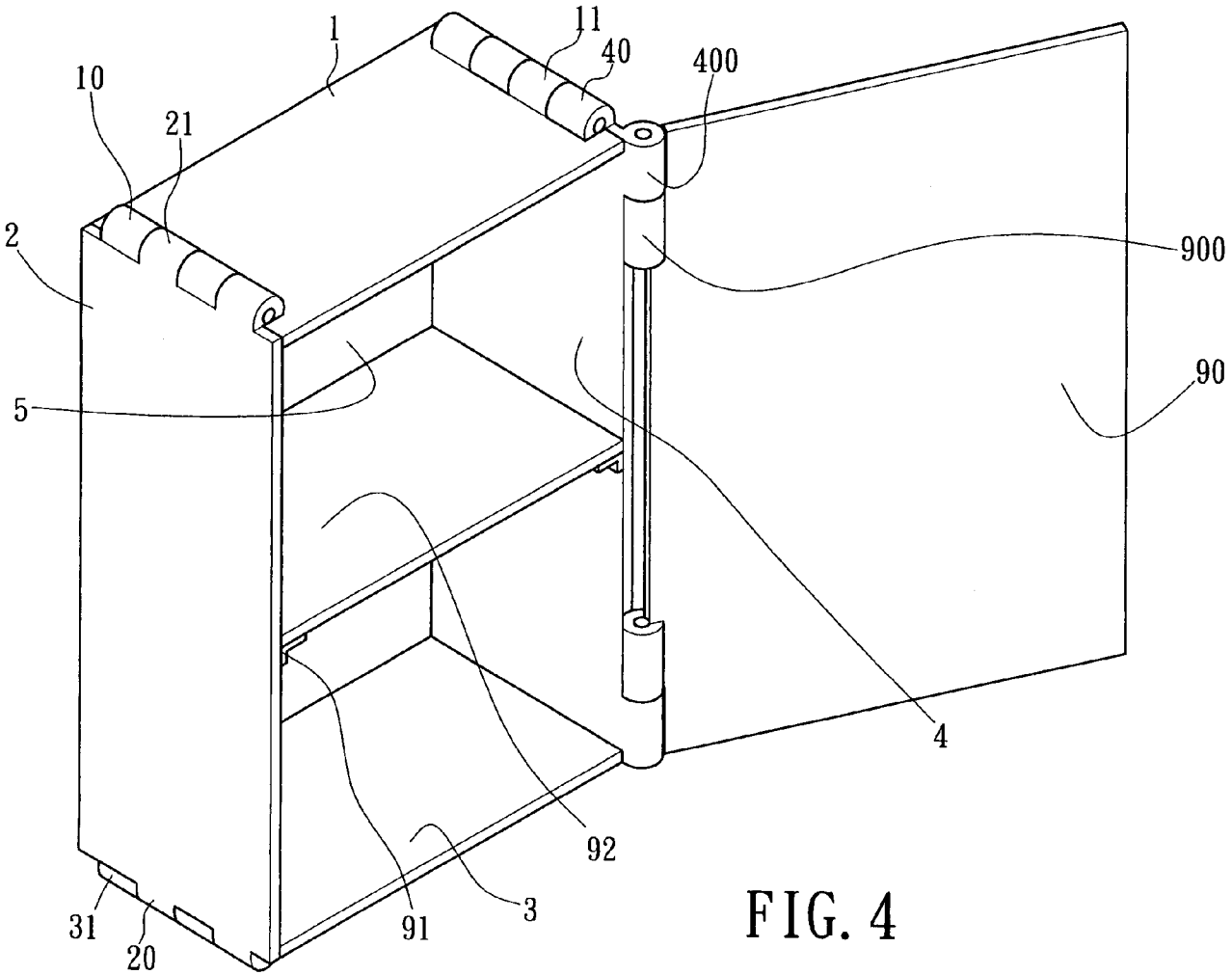
FIG. 4 shows that a cabinet is assembled by the structure same as the drawer assembly of the present invention.

Similarly, as shown in FIG. 4, the drawer assembly can be used upright as a cabinet wherein several stops 91 are connected to an inside of each of the front panel 4 and the rear panel 2 so as to support a shelf 92 between the front panel 4 and the rear panel 2. A door 90 has two lugs 900 and the front panel 4 further has two lugs 400 one the side opposite to the bottom board 5. Two pins 600 extend through the aligned lugs 400 and 900 so that the door 90 is pivotably connected to the front panel 4.

While we have shown and described the embodiment in accordance with the present invention, it should be clear to those skilled in the art that further embodiments may be made without departing from the scope of the present invention.

What is claimed is:

1. A drawer assembly comprising:

four side boards, each of the four side boards having at least one first lug on each of two ends thereof, at least one second lug on one of two opposite sides of each of the four side boards, the four side boards being connected to form a four-side frame by arranging the respective at least one first lugs on two adjacent ends of two adjacent side boards in alignment with each other, four first pins extending through the aligned at least one first lugs;

a bottom board having at least one third lug on each of four sides thereof, the four side boards being arranged to be connected to the four sides of the bottom board and four second pins extending through the respective at least one third lugs and the respective at least one second lugs, and a front part which includes four sides and a front board connected to the four sides, a handle fixed to an out side of the front board and one of the four side boards is connected to an inside of the front board.

* * * * *